US006725666B2

(12) United States Patent
Tiemann

(10) Patent No.: US 6,725,666 B2
(45) Date of Patent: Apr. 27, 2004

(54) COMBUSTION-CHAMBER ARRANGEMENT

(75) Inventor: Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/232,177

(22) Filed: Aug. 28, 2002

(65) Prior Publication Data

US 2004/0011059 A1 Jan. 22, 2004

(30) Foreign Application Priority Data

Aug. 31, 2001 (EP) ..... 01120992

(51) Int. Cl.[7] ..... F02C 3/00

(52) U.S. Cl. ..... 60/798; 60/752; 60/755; 60/757

(58) Field of Search ..... 60/752, 753, 754, 60/755, 756, 757, 758, 759, 760, 798

(56) References Cited

U.S. PATENT DOCUMENTS

| | | | | | |
|---|---|---|---|---|---|
| 2,544,538 | A | * | 3/1951 | Mahnken et al. | 60/752 |
| 2,651,912 | A | * | 9/1953 | Abbott | 60/755 |
| 3,016,703 | A | * | 1/1962 | Lorett et al. | 60/752 |
| 3,956,886 | A | * | 5/1976 | Sedgwick | 60/753 |
| 4,158,949 | A | | 6/1979 | Reider | |
| 5,319,923 | A | | 6/1994 | Leonard et al. | |
| 6,085,515 | A | * | 7/2000 | Walz et al. | 6/757 |

FOREIGN PATENT DOCUMENTS

| | | |
|---|---|---|
| DE | 41 14 768 | 5/1991 |
| DE | 43 09 200 | 3/1993 |
| DE | 197 15 299 | 4/1997 |
| DE | 197 27 407 | 6/1997 |
| GB | 2 298 267 | 2/1995 |

* cited by examiner

*Primary Examiner*—Ted Kim

(57) ABSTRACT

The invention relates to a combustion-chamber arrangement for gas turbines, having an annular combustion chamber connected to at least one burner and leading into a turbine space, an annular-combustion-chamber wall which defines the annular combustion chamber being of double-shell construction, and an inner shell of the annular-combustion-chamber wall being composed of lining elements releasably arranged on an outer shell of the annular-combustion-chamber wall, and a gap space through which a cooling medium can flow being formed between the inner shell and the outer shell of the annular-combustion-chamber wall. In order to develop such a combustion-chamber arrangement to the effect that it is possible to exchange individual lining elements of the inner shell of the annular-combustion-chamber wall with comparatively little outlay, it is proposed with the invention that the lining elements be of trapezoidal design having in each case a fastening structure, formed in each of the longitudinal sides and directed outward, for releasably fastening to a corresponding mating structure of an adjoining lining element and/or a supporting structure connected to the outer shell.

9 Claims, 2 Drawing Sheets

COMBUSTION-CHAMBER ARRANGEMENT

CROSS REFERENCE TO RELATED APPLICATIONS

This application claims priority to EP/01120992.1 filed Aug. 31, 2001 under the European Patent Convention and which is incorporated by reference herein in its entirety.

FIELD OF THE INVENTION

The invention relates to a combustion-chamber arrangement for gas turbines, having an annular combustion chamber connected to at least one burner and leading into a turbine space, an annular-combustion-chamber wall which defines the annular combustion chamber being of double-shell construction, and an inner shell of the annular-combustion-chamber wall being composed of lining elements releasably arranged on an outer shell of the annular-combustion-chamber wall, and a gap space through which a cooling medium can flow being formed between the inner shell and the outer shell of the annular-combustion-chamber wall. The invention also relates to a gas turbine having such a combustion-chamber arrangement.

BACKGROUND OF THE INVENTION

In principle, various concepts of combustion-chamber arrangements are known for gas turbines. Thus, gas turbines are known in the prior art which have combustion-chamber arrangements which are composed of a multiplicity of individual combustion chambers which open into a common annular gap. The annular gap at the same time constitutes a transition to the turbine space, in which the moving blades and the guide blades of the gas turbine are arranged. During the combustion of a mixture ignited by burners connected upstream of the individual combustion chambers, this mixture consisting of an oxygen-containing fuel gas and a propellant, hot gases which are produced propagate through the individual combustion chambers in the direction of the annular gap and enter the turbine space via the latter in order to drive the moving blades of the turbine there. Another concept of a combustion-chamber arrangement provides for a single annular combustion chamber instead of a multiplicity of individual combustion chambers. Fuel-gas/propellant mixture ignited in burners enters such an annular combustion chamber, continues to burn therein and expands in the direction of a turbine space connected downstream of the annular combustion chamber. The invention relates to a combustion-chamber arrangement which uses the last-mentioned construction, that is to say an annular combustion chamber.

Since the walls of the annular combustion chamber are subjected to high thermal loads on account of the combustion taking place in the interior of the annular combustion chamber, these parts of the gas turbine must be efficiently cooled. To this end, it is known to provide double-shell walls in such annular combustion chambers, an outer shell being arranged on which an inner shell composed of individual lining elements is arranged. Provided in this case between the outer shell and the inner shell is a gap space, through which a cooling medium is directed, the cooling medium convectively cooling the inner shell of the annular combustion chamber.

In order to design the inner shell of the annular-combustion-chamber wall so as to be interchangeable, this inner shell is composed of lining elements releasably connected to the outer shell of the annular-combustion-chamber wall. To this end, rail-like rods are arranged on the outer shell in annular combustion chambers known from the prior art, and hooks arranged on the lining elements are pushed over said rods in order to suspend the lining elements. The lining elements must be pushed over the entire length of the rail-like rods, which requires a correspondingly long space for fitting and removing the lining elements. In this case, the rail-like rods are arranged in the direction of the axial extent of the annular combustion chamber, so that a corresponding fitting space is required in this direction for fitting and removing the lining elements.

The rail-like rods of the annular combustion chambers known from the prior art have a length of about half a meter, so that there must be a fitting space having a length of at least half a meter in the axial direction of the combustion chamber in the direction of flow upstream of or downstream of the end of the rail-like rods. However, as viewed in the direction of flow, the turbine blades are arranged directly downstream of the combustion chamber, and the burner is arranged directly upstream of the combustion chamber, so that sufficient space for fitting or removing the lining elements remains neither upstream of nor downstream of the rail-like rods.

Therefore complicated dismantling of the gas turbine must be effected for fitting or removing the lining elements. Thus, for example, the outer casing must be taken off or the rotor must be additionally removed, which means a great deal of additional work for the exchange of the lining elements. In this respect, there is a considerable demand for a simplification in the construction of such a combustion-chamber arrangement.

SUMMARY OF THE INVENTION

Based on the prior art, the object of the invention is therefore to develop a combustion-chamber arrangement of the type mentioned at the beginning to the effect that it is possible to exchange individual lining elements of the inner shell of the annular-combustion-chamber wall with comparatively little outlay.

To achieve this object, it is proposed with the invention that the lining elements be of trapezoidal design having in each case a fastening structure, formed in each of the longitudinal sides, for releasably fastening to a corresponding mating structure of an adjoining lining element and/or a supporting structure connected to the outer shell.

Due to the trapezoidal design of the lining elements, i.e. the side edges, running at an angle to the end faces which differs from 90°, of the lining elements and also the fastening structures formed laterally on each of the longitudinal sides and directed outward, a slight displacement is sufficient in order to release and remove the trapezoidal lining element from the corresponding mating structures. The other way round, the lining element can be inserted and fastened to the mating structures by means of a slight displacement. In an exemplary embodiment, the axial displacement required for fitting or removing the lining element is only 0.1 to 0.05 meters, which is a marked reduction in the length of the required space compared with the 0.5 meters known from the prior art. Thus the gas turbine need not be further dismantled for fitting or removing the lining elements in a combustion-chamber arrangement according to the invention. Nor is it necessary to remove the outer casing or the rotor.

According to an advantageous development of the invention, grooves or tongues are proposed as fastening structure and mating structure, respectively. In this case, the grooves may be arranged as fastening structure on the longitudinal sides of the lining elements of trapezoidal design, and the tongues may be arranged as mating structure on an adjoining lining element or on the supporting structure connected to the outer shell. Conversely, it is likewise conceivable for the trapezoidal lining element to have a tongue on its longitudinal side, this tongue engaging in a longitudinal groove formed on an adjoining lining element or on a supporting structure connected to the outer shell.

For removal, a lining element arranged in the composite of the inner shell is displaced in the direction of its wider end face, in the course of which the groove can be released from the tongue on account of the trapezoidal design of the lining element, and the lining element can be removed from the complete structure.

A supporting structure connected to the outer shell of the annular-combustion-chamber arrangement is in each case expediently located between the individual lining elements, at least along their longitudinal sides. This prevents the inner shell of the annular-combustion-chamber wall from becoming unstable when an individual lining element is released.

Fitting or removal of the lining elements is further facilitated if they do not extend over the entire axial length of the annular combustion chamber but only cover part of this length, at least two lining elements being arranged one behind the other for the complete lining of the annular combustion chamber in the axial direction. By such a measure, the individual lining elements are kept small and are thus simpler to manipulate.

According to a further advantageous development of the invention, the annular combustion chamber, in its axial extent, is set at an angle to a machine axis defined by the axial extent of the turbine space or the turbine shaft. Such an angled arrangement results in a decreasing diameter of the annular combustion chamber in the direction of the turbine space, as a result of which an axial subdivision of the inner shell of the annular-combustion-chamber wall inevitably leads to trapezoidal segments. Thus trapezoidal lining elements may be used which are all arranged so as to be oriented with their narrower end edge in the direction of the turbine space and with their wider end edge in the direction of the burner.

If the annular combustion chamber, as proposed according to a further advantageous development of the invention, is repeatedly arranged at an angle to the machine axis in different steps, the lining elements in each case extending over an area lying between two angling edges, the trapezoidal lining elements can be kept smaller and so as to be simpler to handle and thus their fitting and removal is facilitated.

To fix the lining elements, it is proposed according to a further advantageous development of the invention that the lining elements in each case have additional fastening structures. Such a fastening structure may be, for example, a fastening opening for a fixing element to be passed through, such as a screw bolt for example. In this case, it is preferred that the fastening opening is arranged on a narrower base side of the trapezoidal lining element. As a further possibility of additionally securing the lining element, a longitudinal groove may be provided on a side opposite the narrower front side. This longitudinal groove may likewise be fastened with a screw bolt. These bolts constitute the only fixed points of the construction, the first in two directions and the second in one direction.

Furthermore, a gas turbine which has a combustion-chamber arrangement with one or more of the features described above is proposed with the invention. According to an advantageous development of the gas turbine, it has an axially displaceable burner insert. By axial displaceability of the burner insert, adequate space can be created for displacing the trapezoidal lining elements. For fitting or removing, the axially displaceable burner insert is simply displaced axially in a direction away from the combustion-chamber wall, and the intermediate space thus produced between burner and combustion-chamber arrangement can be utilized in order to axially displace the trapezoidal lining elements during the fitting or removal.

BRIEF DESCRIPTION OF THE DRAWINGS

Further advantages and features of the invention follow from the description below of an exemplary embodiment with reference to the attached figures. In the drawing.

DESCRIPTION OF THE EMBODIMENTS

Figure 1:
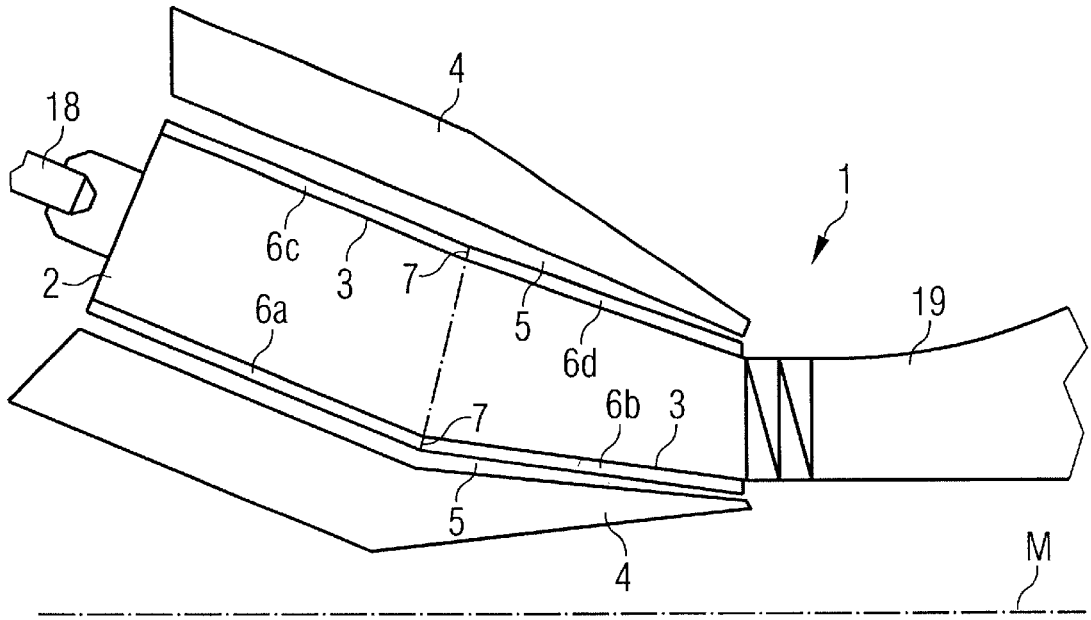
FIG. 1 shows a detail of a gas turbine with a combustion-chamber arrangement according to the invention in a sectioned side view.

A detail of a gas turbine is shown in a sectioned view in FIG. 1, this detail containing a combustion-chamber arrangement 1 according to the invention. The combustion-chamber arrangement 1 according to the invention has an annular combustion chamber 2 which is surrounded by an annular-combustion-chamber wall of double-shell construction. The annular-combustion-chamber wall is composed of an inner shell 3 and an outer shell 4, a gap space 5 being formed between the inner shell 3 and the outer shell 4. A cooling fluid which convectively cools the inner shell 3 of the annular combustion chamber flows through the gap space 5 during the operation of the gas turbine. In this case, the inner shell 3 of the annular-combustion-chamber wall is composed of individual lining elements 6*a* to 6*d*. The latter are releasably connected to the outer shell 4 of the annular-combustion-chamber wall via supporting structures.

At least one burner 18 is connected upstream of the annular combustion chamber, and the annular combustion chamber opens into a turbine space 19. The axial extent of the turbine space 19 or of a turbine shaft defines a machine axis M. The annular combustion chamber is set at an angle to this machine axis M. The annular combustion chamber 2 in the exemplary embodiment shown here is configured with a double angle, as a result of which a parting line 7 running in the circumferential direction of the annular combustion chamber 2 is obtained in the inner shell. In this case, front lining elements 6*a*, 6*c*, i.e. lining elements nearer to the burner 18, and rear lining elements 6*b*, 6*d*, i.e. lining elements nearer to the turbine space 19, abut along the parting line 7 in the axial direction. The lining elements 6*a* to 6*d* are of trapezoidal design, as can better be seen in the following figures.

Figure 2:
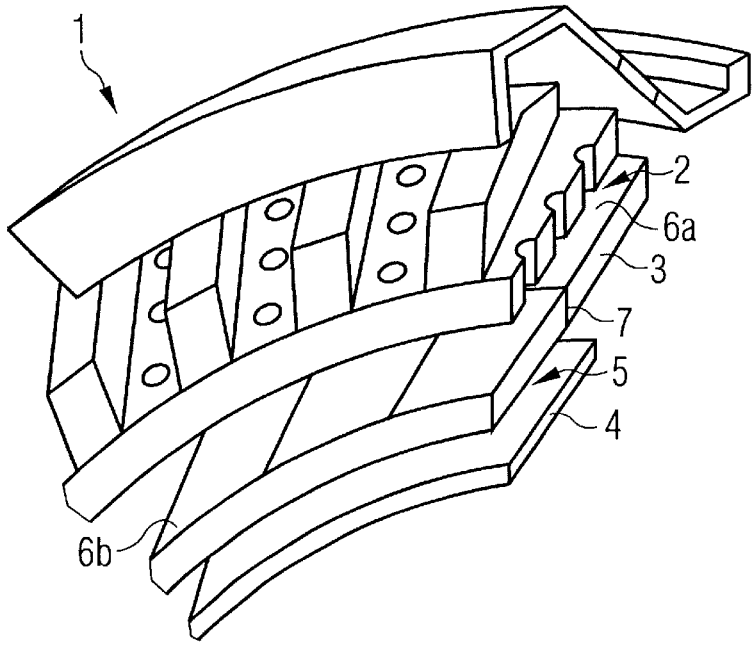
FIG. 2 shows a detail of a combustion-chamber arrangement according to the invention in a perspective representation, as viewed from the direction of the turbine space, and FIG. 3 schematically shows, in a perspective view, a lining element of the combustion-chamber arrangement according to the invention together with supporting structures interacting with the lining element for fixing the lining element on the outer shell of the wall of the annular combustion chamber.

FIG. 2, in a perspective representation, shows a detail of a combustion-chamber arrangement 1 according to the invention, as viewed from the direction of the turbine space. It can be seen very clearly here that the inner shell 3 of the wall of the annular combustion chamber 2 is composed of trapezoidal lining elements 6*a*, 6*b*. Furthermore, the parting line 7, which runs in the circumferential direction of the annular combustion chamber and along which the front and rear lining elements 6*a*, 6*b* abut, can also be seen in this representation. Furthermore, as in FIG. 1, it can also be seen that the annular combustion chamber, starting from the side assigned to the burner, narrows in the direction of the transition to the turbine space, i.e. it is thus of "funnel-shaped" design.

Figure 3:
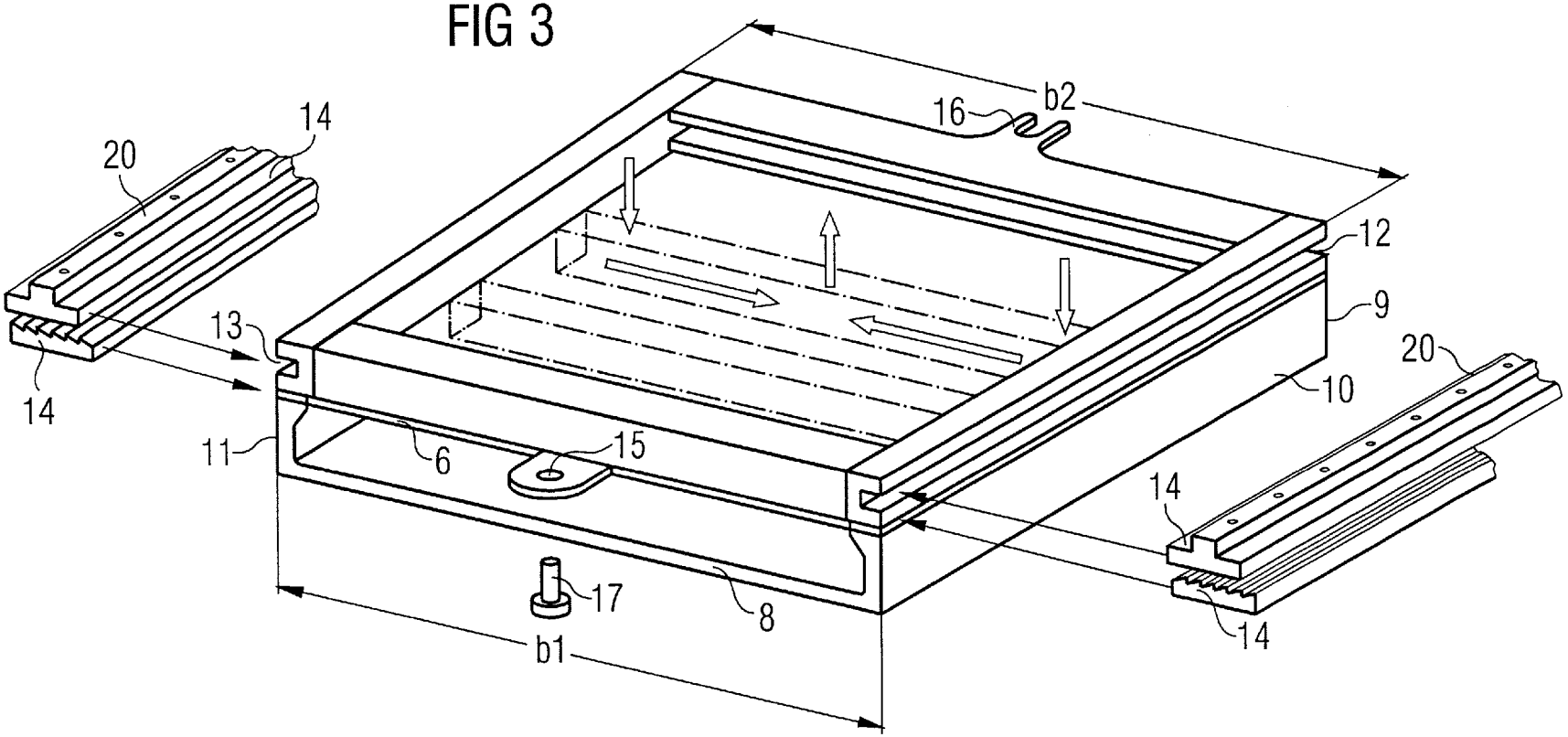

A lining element 6 for constructing the inner shell 3 of the wall of the annular combustion chamber 2 of the combustion-chamber arrangement 1 according to the invention is shown in FIG. 3 in a perspective representation. The lining element 6 has two end faces 8 and 9, opposite one another and running essentially in parallel, and longitudinal sides 10 and 11 connecting the end faces. In this case, the width b1 of the end face 8 shown at the front in the drawing is smaller than the width b2 of the opposite end face 9. This is due to the trapezoid shape of the lining element 6. In the annular combustion chamber 2 shown in FIGS. 1 and 2, the inner shell 3 of the annular-combustion-chamber wall is composed of lining elements 6 in such a way that the end faces 8 having the smaller width b1 point in the direction of the turbine space 19, and the end faces 9 having the larger width b2 are arranged in the direction of the burner 18.

The principle of the suspension of the lining elements 6 can clearly be seen in FIG. 3. Along the longitudinal sides 10 and 11, the lining element 6 has continuous longitudinal grooves 12 and 13, respectively, which interact with tongues 14 of supporting structures 20 acting laterally on the lining element. In this case, the supporting structures 20 are firmly connected to the outer shell 4, shown in FIGS. 1 and 2, of the annular combustion chamber 2 and serve to fasten the lining elements 6, with the gap space 5 being loaded. For fitting or removing, the lining element 6 is displaced by a short distance in the direction of the wide end face 9, that is to say in the direction of the burner, in the course of which the lateral longitudinal grooves 12 and 13, on account of the angular setting resulting from the trapezoid shape, are disengaged from the tongues 14 of the supporting structures 20, and the lining element 6 can thus be removed in a simple manner. The displacement distance required for releasing or fixing the lining element from or to the supporting structures 20 is determined in accordance with the angle at which the longitudinal sides 10 and 11 run relative to the end faces 8 and 9, respectively, of the trapezoidal lining element 6. This displacement distance is at any rate shorter than in lining elements known from the prior art, these lining elements having to be pushed via hook structures onto rails having a length of, for example, half a meter. In an exemplary embodiment, the displacement distance required for fitting or removing the lining elements 6 according to the invention is only about 5 to 15 cm.

In order to additionally secure the lining element 6 in the fitted state, additional fastening structures may be provided, as shown. The latter, in the exemplary embodiment shown, are an opening 15 arranged in the region of the narrower end face 8 and a longitudinal groove 16 arranged in the region of the wider end face 9. Arranged in the region of the opening 15 is a fixing bolt 17, which for fixing the lining element 6 can be passed through the opening 15 and secured to the outer shell of the casing wall. In a similar manner, a further fixing bolt for securing the lining element 6 may be used in the region of the longitudinal groove. Of course, structures other than those shown may be used for the additional fixing of the lining element 6 to the outer shell of the annular-combustion-chamber wall; if need be, such structures may be completely dispensed with.

It is decisive for the invention that the lining element 6 is trapezoidal and has fastening structures which are arranged on the longitudinal sides 10, 11 and which, as shown, can be realized in the form of longitudinal grooves 12, 13. This configuration permits simple fitting and removal of the lining elements with a markedly reduced space requirement compared with the prior art.

In order to simplify the fitting or removal of the lining elements 6*a* to 6*d*, axial displaceability of the burners 18 relative to the annular combustion chamber 2 may be provided. If the burner is displaced axially away from the combustion chamber 2, a free space is thus created, and this free space may be utilized for the displacement of the lining elements 6*a* to 6*d* during the fitting or removal.

A combustion-chamber arrangement in which the lining elements of the inner shell of an annular combustion chamber can be fitted or removed with markedly less outlay compared with the prior art is specified with the invention. The invention at the same time specifies a novel gas turbine which uses the annular-combustion-chamber arrangement according to the invention.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A combustion chamber arrangement for gas turbines, comprising an annular combustion chamber wall having a double-shell construction, with an inner shell and an outer shell, with a gap space being defined by the inner shell and outer shell through which a cooling medium can flow there between, at least one burner connected to one end of the annular combustion chamber leading into a turbine space, and wherein the inner shell being composed of lining elements having longitudinal sides and being releasably arranged on the outer shell, wherein the lining elements are of trapezoidal design and are connected to a supporting structure of the outer shell by pushing a fastening structure into a mating structure in a direction along the longitudinal sides and wherein the lining elements having wide end faces and narrower ends faces wherein the lining elements are all arranged so as to be oriented with the wider end faces in the direction of the burner and the narrower end faces in the direction of the turbine space and wherein a longitudinal groove is arranged on the wider end face of the lining elements as further fastening structure.

2. The combustion chamber arrangement as claimed in claim 1, wherein each longitudinal side having a least one longitudinal groove with the supporting structure and fastening structure located in the longitudinal groove for maintaining the lining elements in place.

3. The combustion chamber arrangement as claimed in claim 2 further comprising second fastening structures formed in the latitudinal side of the lining elements for the releasable fixing to the outer shell.

4. The combustion chamber arrangement as claimed in claim 3, further comprising an opening arranged in the second fastening structure on a narrower end face of the liners is provided for the placement of a fastening device to further fasten the lining elements.

5. The combustion chamber arrangement as claimed in claim 1 wherein the annular combustion chamber has an axial direction and at least two lining elements are arranged in sequence one behind the other in the axial direction of the annular combustion chamber, and adjoining one another along a parting line running in the circumferential direction of the annular combustion chamber.

6. The combustion-chamber arrangement as claimed in claim 1 wherein the annular combustion chamber, in its axial orientation, is set at an angle to a machine axis defined by the axial extent of the turbine space for a machine that the combustion chamber is used upon.

7. The combustion chamber arrangement as claimed in claim 6 wherein the annular combustion chamber is subdivided in its axial extent into at least two sections which are set at different angles to the machine axis, and the lining elements extending continuously over individual sections of the annular combustion chamber in the axial direction.

8. The combustion chamber arrangement as claimed in claim 1 wherein the at least one burner comprises a plurality of axially displaceable burners.

9. A combustion chamber arrangement for gas turbines, comprising an annular combustion chamber wall having a double-shell construction, with an inner shell and an outer shell, with a gap space being defined by the inner shell and outer shell through which a cooling medium can flow there between, at least one burner connected to one end of the annular combustion chamber leading into a turbine space, and wherein the inner shell being composed of lining elements having longitudinal sides and being releasably arranged on the outer shell, wherein the lining elements are of trapezoidal design and are connected to a supporting structure of the outer shell by pushing a fastening structure into a mating structure in a direction along the longitudinal sides, wherein a displacement distance on the supporting structure for changing the lining elements is less than 15 cm.

* * * * *